US005676085A

United States Patent [19]

Michl, Jr.

[11] Patent Number: 5,676,085

[45] Date of Patent: Oct. 14, 1997

[54] VACUUM OPERATED BOAT MOORING DEVICE

[75] Inventor: Maurice W. Michl, Jr., Redding, Calif.

[73] Assignee: Northern Pacific Development Corp., Redding, Calif.

[21] Appl. No.: 675,223

[22] Filed: Jul. 8, 1996

[51] Int. Cl.[6] ..... B63B 2/00

[52] U.S. Cl. ..... 114/230; 114/249

[58] Field of Search ..... 114/230, 249, 114/250, 253

[56] References Cited

U.S. PATENT DOCUMENTS

| | | | |
|---|---|---|---|
| 2,938,492 | 5/1960 | Kulick | 114/230 |
| 3,974,794 | 8/1976 | Kakitani et al. | 114/230 |
| 4,686,926 | 8/1987 | Vance | 114/230 |
| 4,729,331 | 3/1988 | Eggleston | 114/230 |
| 4,817,551 | 4/1989 | Matson | 114/230 |
| 5,046,442 | 9/1991 | Hay | 114/230 |

FOREIGN PATENT DOCUMENTS

| | | | |
|---|---|---|---|
| 1580863 | 9/1989 | France | 114/230 |

*Primary Examiner*—Jesus D. Sotelo

[57] ABSTRACT

A vacuum operated mooring device consisting of a telescopic and lockable connecting arm, to connect and hold apart at a distance, one boat from another or a boat from a dock. At both extremities of the connecting arm are single and multiple axes connected to manually operated vacuum devices that produce a continuous supply of vacuum, within limits, and supply the vacuum to rubber suction cups attached to the boats. By means of the multiple axes extremities of the mooring device, these suction cups can be connected to a multitude of connecting points, either on the side of the hull or on top of the deck of the boat. By the unique use of the vacuum device and rubber suction cups there is no need to have permanent brackets installed on any boat that this device is to be used upon, thus the vacuum device and vacuum cups of this invention allow for quick and easy installation and removal.

14 Claims, 4 Drawing Sheets

10
8A
6B
14
36
58
60
54
64
34
6
3
X
Y
Z
46
80
54,64
38
40
42

VACUUM OPERATED BOAT MOORING DEVICE

FIELD OF THE INVENTION

This invention relates to a boat mooring device, specifically an improved vacuum operated mooring device.

DESCRIPTION OF PRIOR ART

There is extensive prior art relating to devices to moor and hold apart one boat from another and a boat from a dock. The previous art includes rubber bumpers or fenders that are designed to be attached between two boats or a boat and a dock. These bumpers are to be positioned to dampen and soften the effect of the bumping and rubbing which occur between boats or a boat and a dock due to the action of wind and waves. These bumpers can easily become displaced due to this wind and wave action and often result in damage to the boat or the dock.

The Pat. No. 4,686,926 to Vance, Aug. 18, 1987 shows a boat to a dock mooring device with rigid arms and a spring spacer between these arms, all attached to permanent brackets bolted to a dock and a boat. When not in use, the brackets permanently attached to the boat are unattractive looking and in an awkward position on the deck of the boat. When connecting the spacing arms to the permanent brackets on the boat, the alignment needs to be exactly perpendicular between the arms and the openings in the brackets. Considering the wind and wave action rocking and pitching the boat, hooking up this device could be most difficult, if even possible, under most conditions.

The device in U.S. Pat. No. 2,938,492 to Kulick, May 31, 1960 has a telescopic arm, to space a boat from a dock, but as in the previous patent, requires permanent brackets attached to the deck of the boat. These brackets are bolted in position through the deck of the boat and cannot be easily moved. This limits the positions to which the boat can be connected to the dock. This device is complicated to install and not practical for use by most small boat owners. Most of the newer small pleasure craft are made of fiberglass and designed to be sleek in shape with smooth and uncluttered surfaces on the exterior areas of the hull and deck and not desirous of unsightly permanent mooring brackets.

As seen in U.S. Pat. No. 3,974,794 to Kakitani et al., this invention involves an elaborate installation of many various components, including a motor driven vacuum pump. Once the pump creates a vacuum in the oversized vacuum cups attached to a large ship, the towing of the large ship commences. By the magnitude of this invention it is not designed to be used in small craft application. In all of the previously mentioned art, permanent brackets or devices are required to be attached to the boat.

In U.S. Pat. No. 4,817,551 to Matson, Apr. 4, 1989 the device requires no permanent brackets to be installed on a boat as long as the boat has a rail or a cleat already installed where the attaching apparatus of the device is to be connected. Most boats would not have a rail or cleat in exactly the right position for the attachment of the device, therefore a rail or cleat would have to be installed.

The prior art as seen in U.S. Pat. No. 5,046,442 to Hay, Sep. 10, 1991 also does not require any special brackets to be installed on a boat, if there are appropriate cleats both fore and aft. The complexity of the actual connection is due to the amount of ropes, cleats, eyebolts and knots required to tie this device into place and makes it unattractive to the average boater.

OBJECTS AND ADVANTAGES

Accordingly, the advantages of my invention contain the elements to quickly connect one boat to another, connect a boat to a dock and holding them apart at a safe distance. All without the need of permanent connecting brackets installed on the boat. The vacuum operated suction devices at either end of the mooring invention takes only a few seconds to activate and will hold tight to flat smooth surfaces. The suction cups of this device will also attach to moderately curved surfaces such as the sides of many different craft. These vacuum devices are designed to create and hold a vacuum, upon attachment to the boat. This is achieved by the use of a built in spring and plunger mechanism that causes a continuous vacuum to be retained for an extended period of time.

As a further feature of this invention, the telescopic and adjustable connecting tubes allow the suction cups at either end of this device to be positioned and easily connected to two boats. By adjusting the tubes to the distance between two boats, within limits of the tubes, and the locking in place by means of an offset cam and locking mechanism, the device positions the suction cups at exactly the right distance for connection. As still a further feature of this invention, there are built in axes on both ends of this device. On one end of the device there is a single axis, that attaches to a boat by means of a suction cup at the end. The single axis movement should be in a position to only move up and down. This will cause the connecting tubes to be held perpendicular to the boat from the attachment point. This will hold the second boat attached to the other end of this device at a safe distance and parallel to the first boat.

On the opposite end of the device there is a multiple axes movement which allows the suction cup at the end to be attached to the second boat at any angle or position within reach of the telescoping tubes, either on the side of the hull or the top of the deck. The difference in size, of two boats to be attached, will determine the best connecting points on either boat. Once a pair of these devices are installed, one fore and one aft, the single and multiple axes extremities will allow either end of either boat, the ability to move up and down in a single vertical plane, independent of the movement at either end of either boat. While this movement is occurring, these two boats will be held parallel and apart at a fixed and safe distance.

Another advantage of this invention is having the shock of the wind and wave action at the connection points to the boats reduced by the stretching of the suction cups. The cups substantially flex and stretch between the connection point on the boat and where they are attached to a flange, yet still hold tight and do not move from where attached. Once the suction cups are removed, thus removing the entire device, there are no permanent brackets still attached to the boat. This complete device can then easily be stored in an accessory bag under the bow of the boat.

Still another element of this invention, a boat to a dock mooring device, is created by attaching the single axis end of this device to a dock mounted bracket and the multiple axes end to a boat. The advantages, stated previously will apply to the dock attached version of the invention.

The apparatus of the present invention couples ease of use with the efficiency to be attached and disengaged quickly while requiring no permanent brackets attached to the boat. Various configurations for the use of this invention are disclosed in the drawings.

Further objects and advantages of this present invention will become apparent from consideration of the drawings and ensuing description.

Drawing Reference Numerals Worksheet

Figures 1, 2, 3:
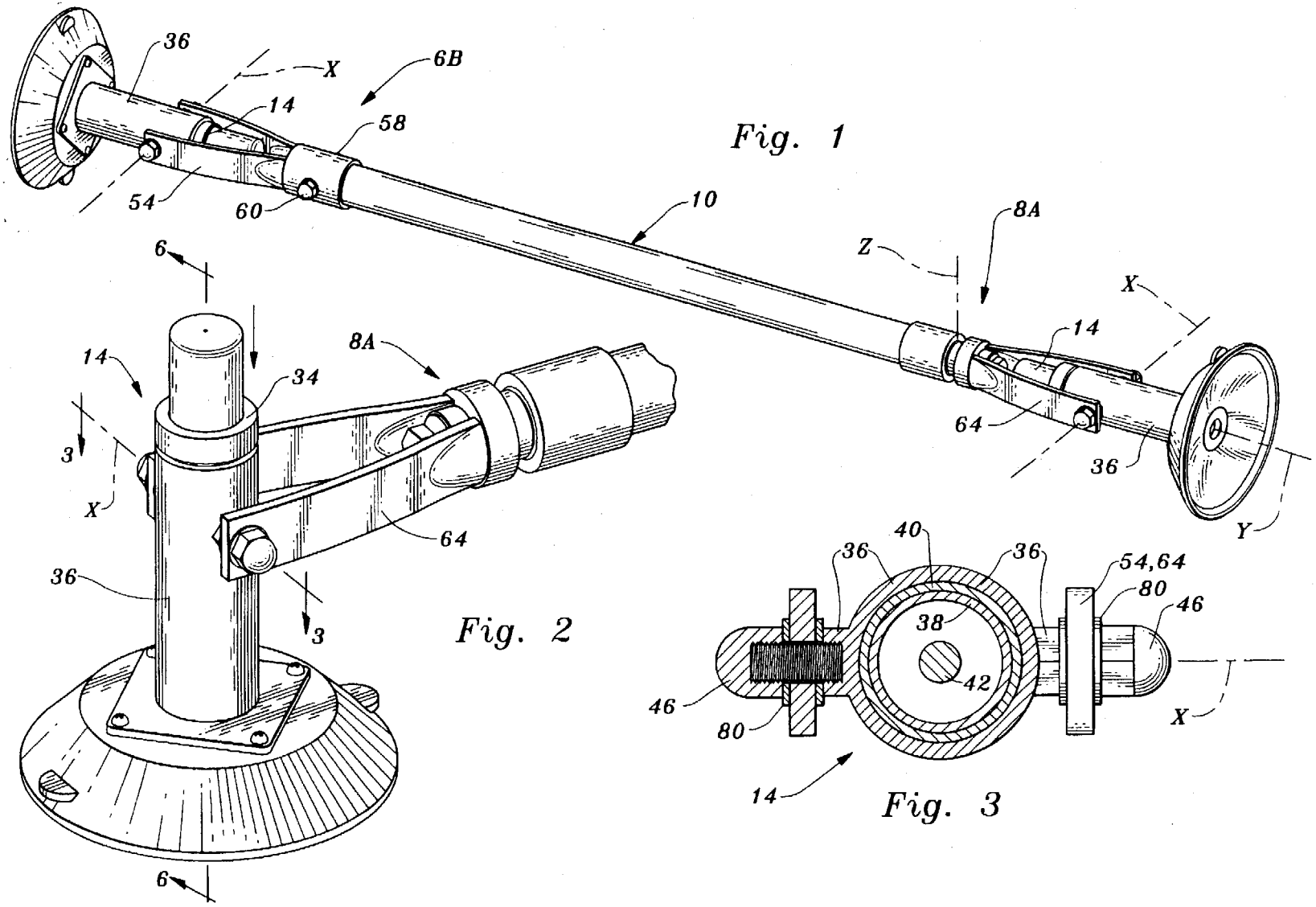
FIG. 1 is a perspective view of an embodiment of the invention as it would appear prior to application.
FIG. 2 is a perspective view of the multiple axes end of this device and the continuous vacuum operated suction cup device.
FIG. 3 is a sectional view of an embodiment of this invention shown along line 3—3 of FIG. 2.

| | PART NAME |
|---|---|
| 6b | single axis attaching end |
| 8a | multiple axes attaching end |
| 10 | vacuum operated mooring device |
| 12 | rubber vacuum cup |
| 14 | continuous vacuum device |
| 16 | vacuum release tabs |
| 18 | machine screws |
| 20 | hex bolt |
| 22 | offset locking cam |
| 24 | washer |
| 26 | outer telescopic connecting tube |
| 28 | inner telescopic connecting tube |
| 32 | polyurethane bushing |
| 34 | locking collar ring |
| 36 | vacuum device sleeve |
| 38 | vacuum plunger |
| 40 | vacuum plunger case |
| 42 | vacuum piston case |
| 46 | cap bolt |
| 48 | vacuum device flange |
| 50 | polyurethane bushing |
| 54 | yoke |
| 56 | tubing sleeve |
| 58 | hex bolt |
| 60 | cap nut |
| 64 | yoke |
| 68 | spacer |
| 70 | vacuum area |
| 72 | vacuum chamber |
| 74 | extension spring |
| 76 | piston head |
| 77 | rubber vacuum seal |
| 80 | plastic bushing |
| 82 | air channel |
| 84 | dock bracket |
| 86 | retaining bracket |
| 88 | lag screws |
| 100 | dock |

DESCRIPTION OF THE PREFERRED EMBODIMENT

In the description, like parts, will be identified with identical reference numerals.

Figure 4:
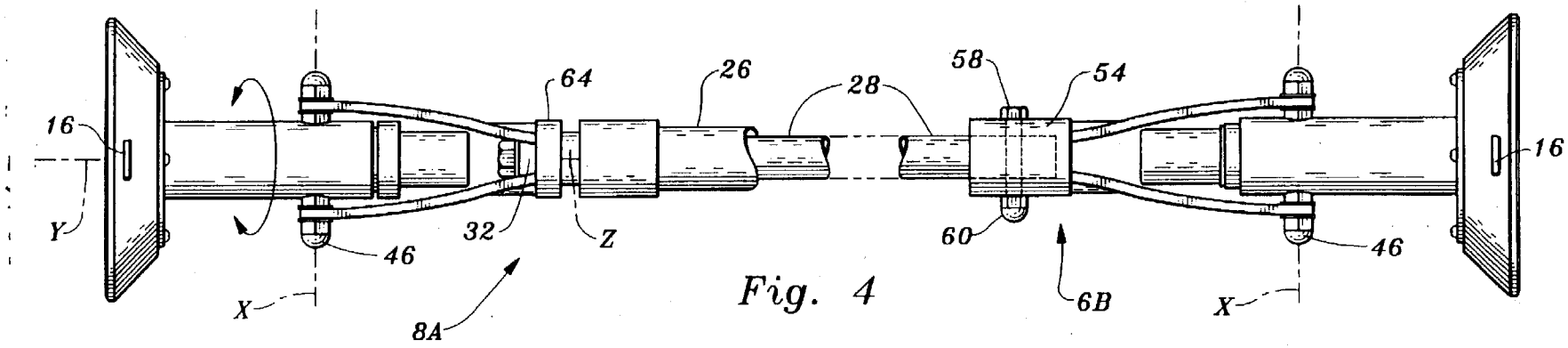
FIG.4 is a plan top view of the main embodiment of the invention.
Figure 5:
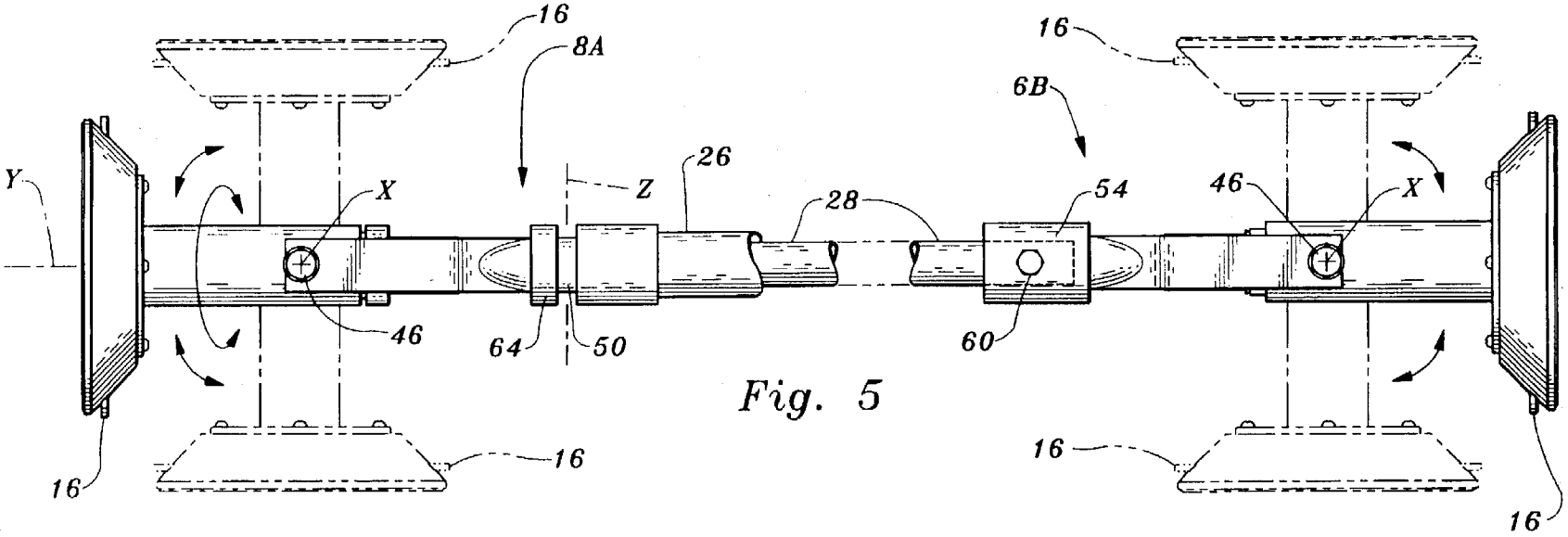
FIG.5 is a plan side view illustrating some of the axes of the invention.
Figure 6:
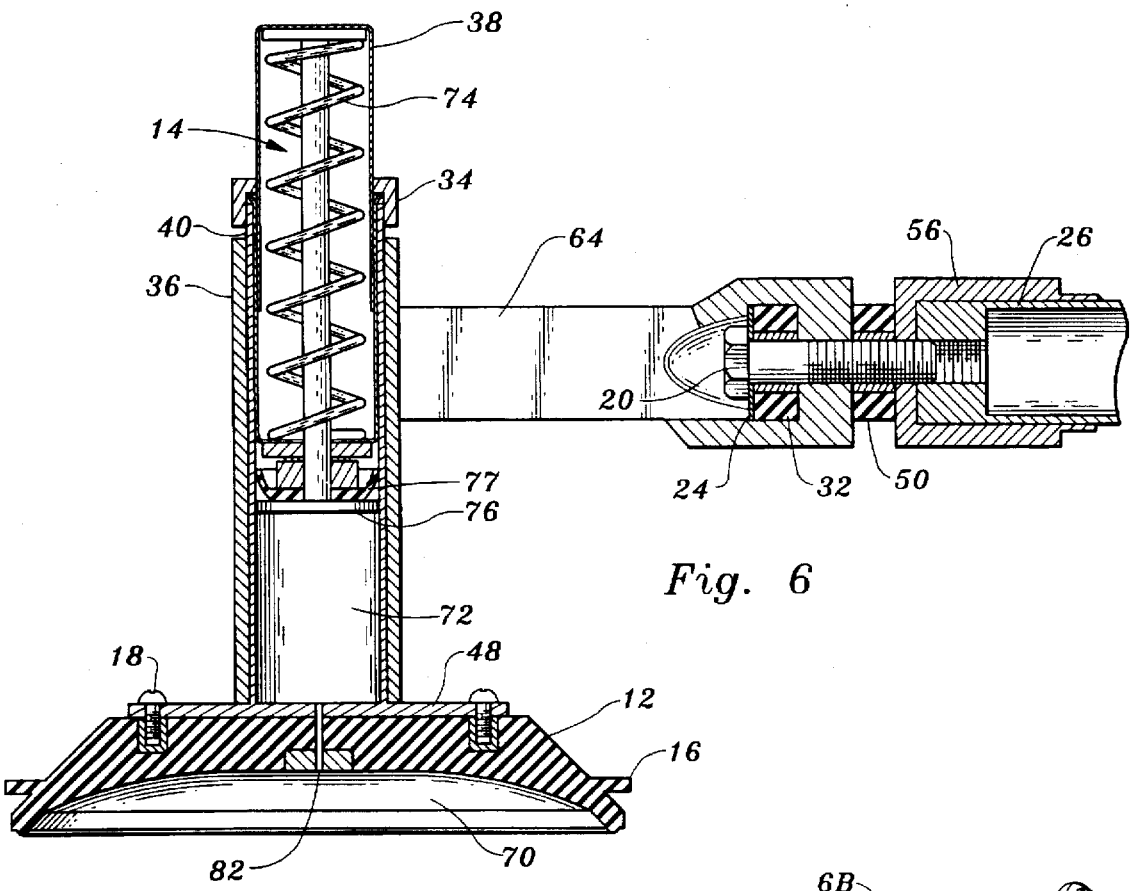
FIG. 6 is a sectional view of FIG. 2 along line 6—6 of FIG. 2.
Figure 8:
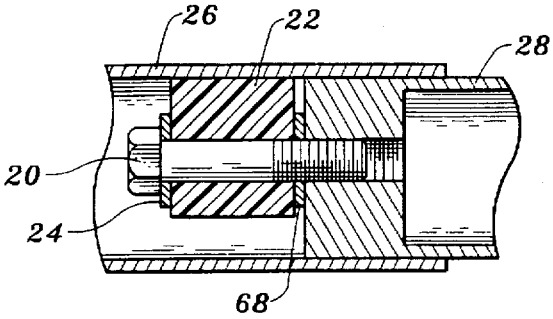
FIG. 8 is the sectional view of the offset cam locking device, shown along line 8—8 of FIG. 7.

Turning now to the drawings, a pair of identical vacuum operated mooring devices 10 in FIG. 1. The device 10 in FIG. 1 shown in a perspective side view showing an embodiment of the entire vacuum operated mooring device. The device includes a set of telescopic tubes, one inside the other. The inner tube 28, best shown in FIG. 4, slides to the desired connecting position along the limits of travel of outer tube 26 and locks to tube 26 shown in FIG. 4, by the use of offset cam 22 shown in sectional detail FIG. 8. As shown in FIG. 8, this cam device 22 is bolted to the solid end of tube 28 by hex bolt 20 and washer 24 and into tube 28 end threads. Cam 22 is separated from the solid end of inner tube 28 by spacer 68 to eliminate some of the friction between cam 22 and solid end of tube 28. On the opposite end of telescopic tube 28, tube 28 is attached to yoke 54 on the single axis end 6B as best shown in FIG. 4 and FIG. 5. This attachment is completed by bolting yoke 54 to tube end 28 and by using hex bolt 58 and cap nut 60. Yoke 54 is then bolted to vacuum device sleeve 36 in FIG. 1 by cap bolt 46 passing through plastic bushing 80 then through yoke 54 and into threads in sleeve 36 as shown in FIG. 3, a sectional view of this connection. This connection is the same on both sides of sleeve 36. Vacuum device 14 is inserted through sleeve 36 and epoxy glued or the like in a fixed position as seen in FIG. 2 and FIG. 3. On the opposite end, telescopic tube 26 is attached to yoke 64 the multiple axis end 8A, as shown in FIG. 4 and FIG. 5. This attachment is completed as best shown in FIG. 6 with hex bolt 20 passing through washer 24 and polyurethane bushing 32, then through yoke 64 and another polyurethane bushing 50 and on through tubing sleeve 56 and into solid end threads of tube 26. The single hex bolt 20 holds together and connects this entire multiple axes 8A. The polyurethane bushings 32 and 50 are installed to relieve some of the compression factor in the mooring device 10. Vacuum device sleeve 36 on the multiple axes end 8A is bolted to yoke 64 the same way as shown in FIG. 2 and the exact same way as the other sleeve 36 is bolted at single axis end 6B to yoke 54 as shown in FIG. 3. The continuous vacuum device 14 at the multiple axes end 8A is inserted into sleeve 36 as seen in FIG. 2, this sleeve 36 is the same on both ends of mooring device 10. Vacuum device 14 is exactly the same on both ends of mooring device 10, except that on the multiple axes end 8A continuous vacuum device 14 is retained in place through sleeve 36 by a locking collar ring 34 as best seen in FIG. 2, so that continuous vacuum device 14 will rotate 360 degrees in sleeve 36 as seen in FIG. 4. The tubes 26 and 28 shown in FIG. 4 are rigid in the sense that they resist compression and expansion, within limits, they are locked into position by cam 22 and under non extreme conditions. This device is primarily intended for use with boats, crafts and objects of average size. A variation of materials and methods of construction in this mooring device may become desirable considering the possible usage with different size and weight boats. It should be understood, modifications can be made without departing from the scope of this invention.

FIG. 2 shows a perspective of multiple axes end 8A and shows a sectional through lines 6—6 for FIG. 6 and a sectional through lines 3—3 for FIG. 3.

FIG. 3 is a top sectional view of vacuum device 14 through vacuum sleeve 36. Vacuum device 14 is best seen and described in FIG. 6.

FIG. 4 is a top plan view of my complete mooring device 10 and shows the X, Y & Z axes at multiple axes end 8A. At the single axis end 6B it shows the other X axis through bolt 46 which is the same X axis on both ends of this device.

FIG. 5 is a side plan view of my complete mooring device 10 showing the rotational possibilities through the X axis of the attaching ends 6B and 8A.

FIG. 6 is a sectional view of the continuous vacuum device 14. FIG. 6 shows how extension spring 74 causes a continuous reverse pressure on piston head 76. When plunger 38 is depressed and released, a vacuum is created in vacuum chamber 72 and continues through air channel 82 thus causing vacuum cup area 70 to hold a continuous vacuum within the area of vacuum cup 12, so that cup 12 will hold to any smooth surface to which it is attached. As vacuum decreases in cup area 70 over a period of time, the spring 74 has a continuous reverse pull on piston head 76 to maintain vacuum in chamber 72 and area 70, thus causing a continuous vacuum within the limits of the extension of spring 74. This continuous vacuum will be retained for an extended period of time. Flange 48 a permanent part of vacuum device 14 is attached to vacuum cup 12 by (4) screws 18. Release tabs 16, when pulled up and away from the surface of a boat that cup 12 is attached to, causes a release of the vacuum in cup 12 and thus releases vacuum device 14.

Figure 7:
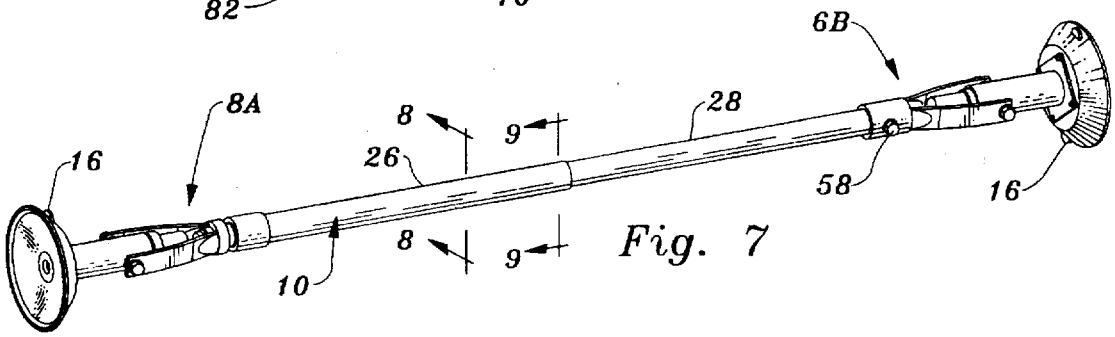
FIG. 7 is a perspective view of the entire invention showing placement of sectional FIG. 8 and cross section FIG. 9.

FIG. 7 is a perspective view of the entire device 10 in a partially extended position. A sectional line 8—8 is shown for position of FIG. 8 a sectional view and a sectional line 9—9 is to show in FIG. 9 a cross section of FIG. 8.

FIG. 8 is a sectional view of offset cam 22 and the connection to tube 28 previously described.

Figure 9:
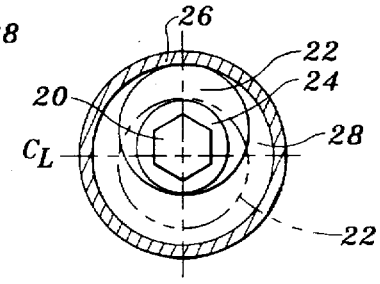
FIG. 9 shows a cross section of FIG. 8 shown along line 9—9 of FIG. 7.

FIG. 9 is a cross sectional view of FIG. 8 with cam 22 and how it works. Tube 28 is shown with hex bolt 20 and washer 24 being installed in an eccentric position to the actual center line of tube end 28, so that when tube 26 is rotated, cam 22 locks inner tube 28 to outer tube 26 in a fixed position, within the limits of the length of outer tube 26 and inner tube 28. This telescoping ability of tubes 26 and 28 enables the user of device 10 to connect one vacuum device 14 to one boat and then extend tubes 26 and 28 outward to a connecting point for the other exact vacuum device 14, to be attached to the second boat. After it is attached, lock the tubes 26 and 28 in place thus holding a fixed position. It takes a pair of these mooring devices 10 to make a complete connection between two boats as seen in FIG. 10.

Figure 10:
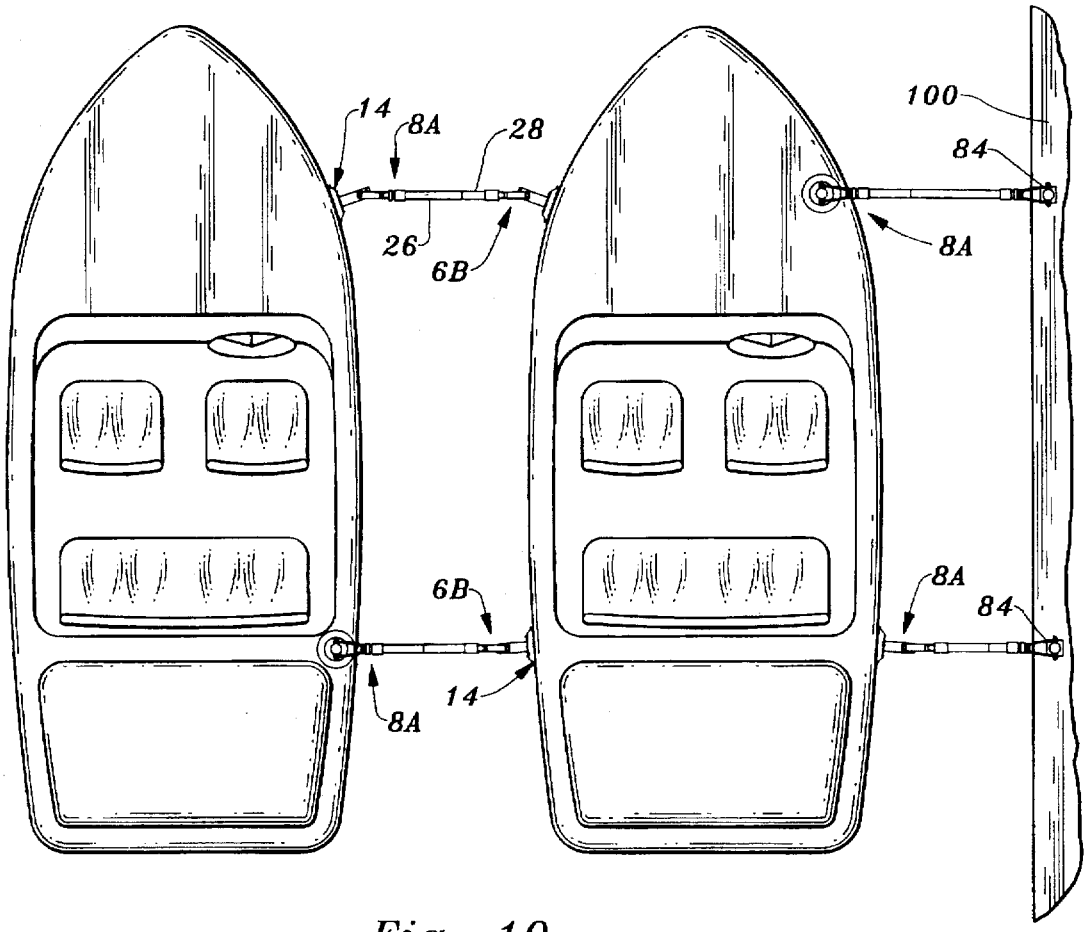
FIG. 10 is a top plan view showing the actual connection of two boats and connection to a dock.

FIG. 10 shows another embodiment of this vacuum operated mooring device 10. Device 10 is connected from different positions on one boat to different positions on a second boat through the multiple axes end 8A and single axis end 6B and fixed by the telescoping tubes at the desired distance between the two boats. The first boat is then connected from the other side of the boat to a dock 100, by attaching two permanent brackets 84 to the dock 100. By bolting with (4) lag screws 88 in each, and attaching a pair of mooring devices 10 from the dock brackets 84 to the boat, this enables a single docking space, to accommodate two boats.

Figure 11:
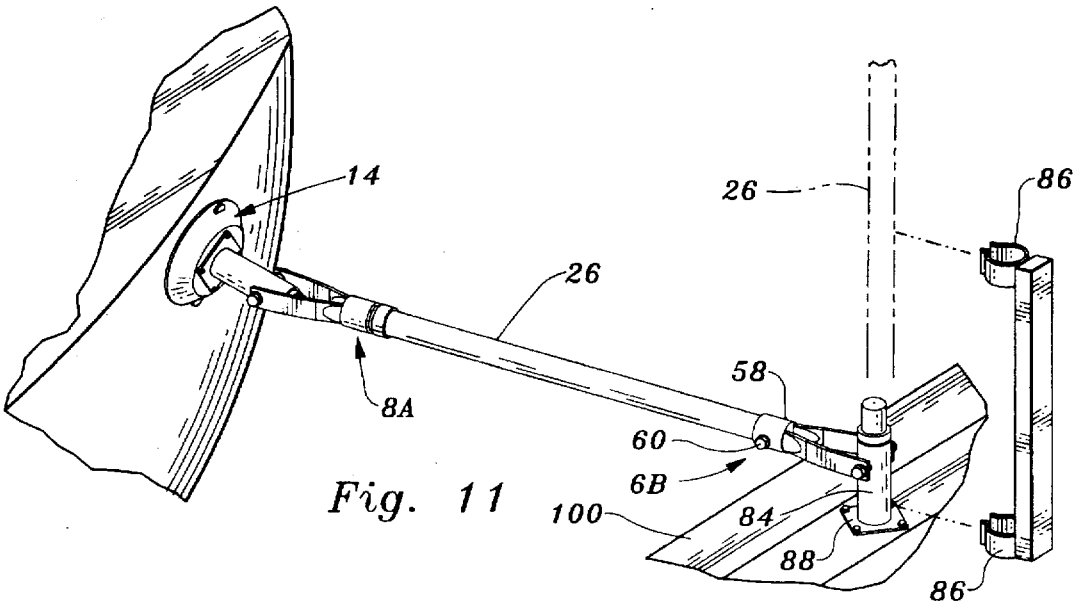
FIG. 11 is a perspective view of another feature of this invention; boat to dock bracket.

FIG. 11 shows a perspective view of the alternate dock mount 84 attached to the dock 100 by (4) lag screws 88 and mooring device 10 attached from mount 84 to the boat hull at multiple axis end 8A. The retaining bracket 86 is shown in a position to hold mooring device 10 in an upright position until needed.

OPERATION OF THE INVENTION

The manner of using my vacuum operated boat mooring device 10 is best shown in FIG. 10. This device will connect and hold two boats safely connected together, by simply attaching a pair of my devices 10 between the two boats. As seen in FIG. 10, the four connecting points selected must be at opposite ends of each of the boats, but either boat may be facing in either direction and not necessarily the same direction. Connecting my mooring device 10, one at either end of the boats, will properly hold the boats safely apart and in the desired position. Through movement in all of the built-in axes of device 10, the boats connected can move freely up and down and independent of each other in a vertical plane.

To connect mooring device 10 between two boats, first place rubber vacuum cup 12, on the single axis end 6B of mooring device 10, at any position desired, either on the side of the hull, or on top of the deck of the first boat as shown in FIG. 10. Hold mooring device 10 towards the second boat to be connected and towards the desired connecting point on the boat. Press the rubber vacuum cup 12 firmly in place on the first boat and then press vacuum plunger 38 with the palm of your hand two to three times. This action creates a tremendous vacuum within the vacuum chamber 72 of the continuous vacuum device 14 as seen in FIG. 6. The vacuum is transferred through air channel 82 and into vacuum area 70, thus allowing vacuum cup 12 to firmly be attached to the boats hull or deck. The built-in flexibility of the rubber suction cup 12 conforms and holds tight to moderately curved surfaces, allowing attachment of cup 12 to the surface of most boats.

As seen in FIG. 6, extension spring 74 causes a continuous reverse pull on piston head 76 and vacuum seal 77; to create vacuum in chamber 72, air channel 82 and vacuum area 70 within cup 12 for an extended period of time. By pumping plunger 38 two or three times the vacuum created in vacuum device 14 can be sustained for up to several days. You can check on the vacuum still available within the vacuum area 70 of vacuum cup 12, a part of vacuum device 14, by visually checking how far vacuum plunger 38 has raised above the vacuum plunger case 40 best seen in FIG. 6. This plunger 38 will move in an upward direction, within the limits of travel of plunger 38, as the available vacuum level decreases. There is a red line near the end of the upward travel of plunger 38. After a considerable period of time the red line will appear as plunger 38 travels upward. This is a visual signal to re-pump plunger 38 two or three times and re-establish the vacuum within vacuum device 14 for an additional period of time. As the mooring device 14 is held in place by vacuum cup 12 on the first boat and the mooring device 10 is pointed in a direction towards a selected connecting point on the second boat, release locking cam 22 inside the telescoping tubes 26 and 28 by holding tightly to yoke 54 and turning outer tube 26. After cam 22 is released as seen in FIG. 8 and FIG. 9, extend outer tube 26 over the inside tube 28 towards the second boat, as seen in FIG. 7. Multiple axes end 8A will come in contact with any desired connecting point on the second boat. Press vacuum cup 12 firmly down at the connecting point and depress plunger 38 of vacuum device 14 until the vacuum in device 14 causes cup 12 to become firmly attached to the second boat as seen in FIG. 10.

Turn the outer telescoping tube 26 until locking cam 22 locks into place on the inner telescopic tube 28, as seen in FIG. 8. This holds the two boats at a desired distance. Repeat the same process with the other mooring device 10 at the other end of the boat and the connecting process will be complete, with both boats secure. Each boat will then be able to move independently at either end of either boat and safely be connected together.

The entire hookup procedure of connecting two boats together with two mooring devices 10 takes less than a few minutes to complete and can be accomplished during considerable movement due to wind and wave action.

Multiple axes end 8A has 3 separate axes at the end of mooring device 10 as seen in FIG. 4 and FIG. 5. The Y axis allows for continuous vacuum device 14 to rotate 360 degrees in the vacuum device sleeve 36. When vacuum device 14 is connected to the top of a deck, rotating the X axis to 90 degrees from the center line of the telescoping tubes of mooring device 10, the Y axis can rotate according to the give and take of the rubber vacuum cup 12 attached to the top of the deck. In this position, the Z axis is able to turn in either direction, allowing for the disparity in height of the boat movement due to wind and wave action. The X axis allows the two boats to rise and fall independent of each other. The other end of connecting device 10, the single axis end 6B, attached perpendicular to the first boat, holds the two boats apart and allows for up and down movement as seen in FIG. 10.

To disengage two boats connected together by the mooring devices 10, simply pull up the release tabs 16 on all four vacuum devices 14 and in seconds both boats are no longer restricted.

To connect mooring device 10 to dock 100 as shown in FIG. 10, simply remove locking collar ring 34 from vacuum plunger case 40 as seen in FIG. 6. This will allow vacuum device 14 to be removed from vacuum sleeve 36. Two dock mounted brackets 84 should be bolted to the dock 100 by lag screws 88 and allow sufficient space to hook up a boat, both fore and aft. Place mooring device 10 over the dock brackets 84 and replace locking ring 34 to connect device 10 to bracket 84. Extend mooring device 10 out to the boat by means of the telescoping tubes 26 and 28 and connect to the desired position on the boat with vacuum device 14 and then lock tubes 26 and 28 as described above. This will firmly connect the boat to dock 100 on one end of the boat. Repeat the process by connecting the other end of the boat to the dock by using another mooring device 10 to connect up to another dock bracket 84.

The application of a dock 100 to a boat connection, will also allow for the first boat to be connected to a second boat, by another pair of my vacuum operated mooring devices 10 as shown in FIG. 10. This application of parallel boats connected together and then to a dock 100, is desirable if dock space is limited.

Another feature of my mooring device 10 occurs when disengaging a boat from dock 100. Lift mooring device 10 upward to a vertical position and snap into retaining bracket 86 as shown in FIG. 11 until the next time mooring device 10 is needed.

SUMMARY, RAMIFICATIONS AND SCOPE

Accordingly, the reader will see that the vacuum operated mooring device of this invention offers ease of use and can quickly and efficiently be attached to a boat. Due to the attachment being made by connecting vacuum operated suction cups to the boat, no tools or permanent attachment brackets are needed for connection.

It will thus be seen, that in addition to many different sizes and shapes of the different components of this mooring device, there are many different materials and colors that could also apply to making this device. By modifying, strengthening, or changing the size of these components, there are many different size boats this device can accommodate. Having thus disclosed a preferred embodiment of my invention, many other variations and ramifications are possible.

For example:

It both connects and efficiently holds apart, one boat from another;

It will moor one boat to a dock or a houseboat or the like;

It provides the ability to moor more than one boat at a time, to a dock or houseboat, by hooking boats together parallel;

It provides for quick and easy connection to a boat, even by a novice;

It disengages with the flip of a finger;

It reduces by means of the telescoping tubes to a size easily stored on any boat.

It has the possibility to connect and hold at an adjustable distance, objects or items unknown at this time.

Although the description above contains many specificity's, these should not be construed as limiting the scope of the invention, but as merely providing illustrations of some of the presently preferred embodiments of this invention.

Thus, the scope of this invention should be determined by the appended claims and their legal equivalents, rather than by the examples given.

I claim:

1. A mooring device comprising: an arm and means to connect and hold at a distance two or more objects: the improvement wherein said mooring device requires no permanent brackets on the objects, utilizes a joint incorporating a plurality of axes on an extremity of said mooring device and connects by means of a vacuum device and suction cups to each object.

2. The mooring device of claim 1 wherein said mooring device includes capacity for adjustable length.

3. The mooring device of claim 1 wherein said mooring device will interconnect objects without permanent union of said objects.

4. The mooring device of claim 1 wherein said mooring device interconnects a plurality of objects without permanent union of said objects.

5. The mooring device of claim 1 wherein said joint incorporating a plurality of axes on an extremity of said mooring device, allows for said joint to pivot to a plurality of positions, thereby allowing the vacuum device attached to said joint a multitude of practicable connecting positions for said suction cups to connect to the objects.

6. The mooring device of claim 1 wherein said mooring device contains the vacuum device attached to said joint incorporating said plurality of axes, at each extremity of said mooring device.

7. The mooring device of claim 6 wherein said vacuum device provides a constant vacuum to said suction cups for connecting said suction cups to the objects.

8. The mooring device of claim 7 wherein said suction cups connect and hold onto any smooth surface of said objects.

9. The mooring device of claim 7 wherein said suction cups, without requiring permanent union, complete the connection to said objects.

10. A mooring device comprising: an arm and means to connect and hold at a distance two or more objects, the improvement wherein said mooring device requires no permanent bracket on one of the objects to be connected by said mooring device, utilizes a joint incorporating a plurality of axes on an extremity of said mooring device and connects by moans of a vacuum device and a suction cup to one of the said objects and a permanent fixed bracket to the other said object.

11. The mooring device of claim 10 wherein said mooring device will cause objects to moor without permanent union to one of said objects.

12. The mooring device of claim 10 wherein said mooring device will cause objects to moor in multitude with permanent union of one of said objects.

13. The mooring device of claim 10 wherein said mooring device contains a joint allowing for the vacuum device attached to said joint a multitude of practicable connecting positions for the vacuum cup to connect to one of said objects.

14. The mooring device of claim 13 wherein said mooring device contains apparatus at one extremity of said mooring device to allow for a permanent connection to one said object.

* * * * *